United States Patent [19]

Korhonen-Wesala

[11] Patent Number: 4,486,151

[45] Date of Patent: Dec. 4, 1984

[54] DIAPHRAGM PUMP

[76] Inventor: Veikko Korhonen-Wesala, Box 217, S-450 60 Färgelanda, Sweden

[21] Appl. No.: 377,173

[22] Filed: May 11, 1982

[30] Foreign Application Priority Data

May 13, 1981 [SE] Sweden ..... 8103002

[51] Int. Cl.[3] ..... F04B 1/06; F04B 17/00; F04B 39/10

[52] U.S. Cl. ..... 417/222; 417/270; 417/566; 92/12.2

[58] Field of Search ..... 417/269, 270, 222; 92/122

[56] References Cited

U.S. PATENT DOCUMENTS

| | | | |
|---|---|---|---|
| 2,797,647 | 7/1957 | Floraday | 417/269 |
| 2,957,421 | 10/1960 | Mock | 92/12.2 |
| 2,983,153 | 5/1961 | Zubaty | 92/12.2 |
| 2,991,723 | 7/1961 | Zubaty . | |
| 3,498,229 | 3/1970 | Preslesnik | 417/260 |
| 3,512,178 | 5/1970 | Russell | 417/218 |
| 4,077,269 | 3/1978 | Hodgkinson | 417/269 |
| 4,396,357 | 8/1983 | Hartley | 417/269 |

FOREIGN PATENT DOCUMENTS

| | | | |
|---|---|---|---|
| 450357 | 8/1948 | Canada | 417/269 |
| 2511298 | 9/1975 | Fed. Rep. of Germany | 417/269 |
| 2524148 | 1/1976 | Fed. Rep. of Germany | 417/269 |

*Primary Examiner*—William L. Freeh

*Attorney, Agent, or Firm*—Cushman, Darby & Cushman

[57] ABSTRACT

A diaphragm pump having at least two working chambers communicating with inlet and outlet chambers via non-return valves, includes a reciprocal wobble plate affixed to a diaphragm in the working chambers. The wobble plate has a central guide shaft with a carrier at its free end, the carrier having resilient material, such as a rubber coating or rubber blocks, associated with it. A groove in a rotor connected to a drive shaft receives the carrier. The slope of the guide shaft with respect to the drive shaft is adjustable, and the resilient material holds the carrier in a preset eccentric position with respect to the drive shaft so that under overload conditions the carrier will press against the resilient material and reduce the eccentricity of the carrier with respect to the drive shaft. Once the overload conditions no longer exist, the guide shaft returns to its normal position and normal pumping continues.

16 Claims, 16 Drawing Figures

DIAPHRAGM PUMP

The present invention concerns a diaphragm pump comprising at least two working chambers provided with a diaphragm, an inlet chamber and an outlet chamber, which each communicate with said working chambers respectively through a non-return valve and a mechanism imparting to the diaphragm a reciprocal movement.

Since a long time it has been a wish to provide a self-sucking pump for for example ships, caravans and similar purposes, which can be used as a force pump as well as a suction pump and which by a simple change can be used as a suction pump and a lifting pump. In the first-mentioned embodiment the pump can be used as a pentry pump and then produces a suction as well as a pressure in the case of a limited lifting amount or as a draining pump generating a great lifting amount but a low pressure at the outlet side. It has been a further wish to produce a pump which is relatively insensitive to impurities and which thus can be used even as a draining pump for for example night-soil containers. The pump shall be absolutely tight without a need for lubricating and shall be adjustable for different effects. In the case of overloading, for example at too a high counter pressure, the pump should further be self adjusting, i.e. automatically reduce the pump effect so that the motor is not damaged, and a normal pump effect shall be retained when the counter pressure has become normal. The pump shall work in a silent way and shall be substantially maintainance free.

Up to now, it has not been possible to combine all these wishes in one and the same pump.

The object of the present invention is to provide a pump, which is self-suctioning, dry safe in operation, which has an adjustable working pressure, which can be used both as a force pump and as a draining pump, which can be used for pumping liquids containing particles and which is corrosion resistant. These tasks have been solved by a pump defined in the characterizing clauses of the claims.

Figure 1:
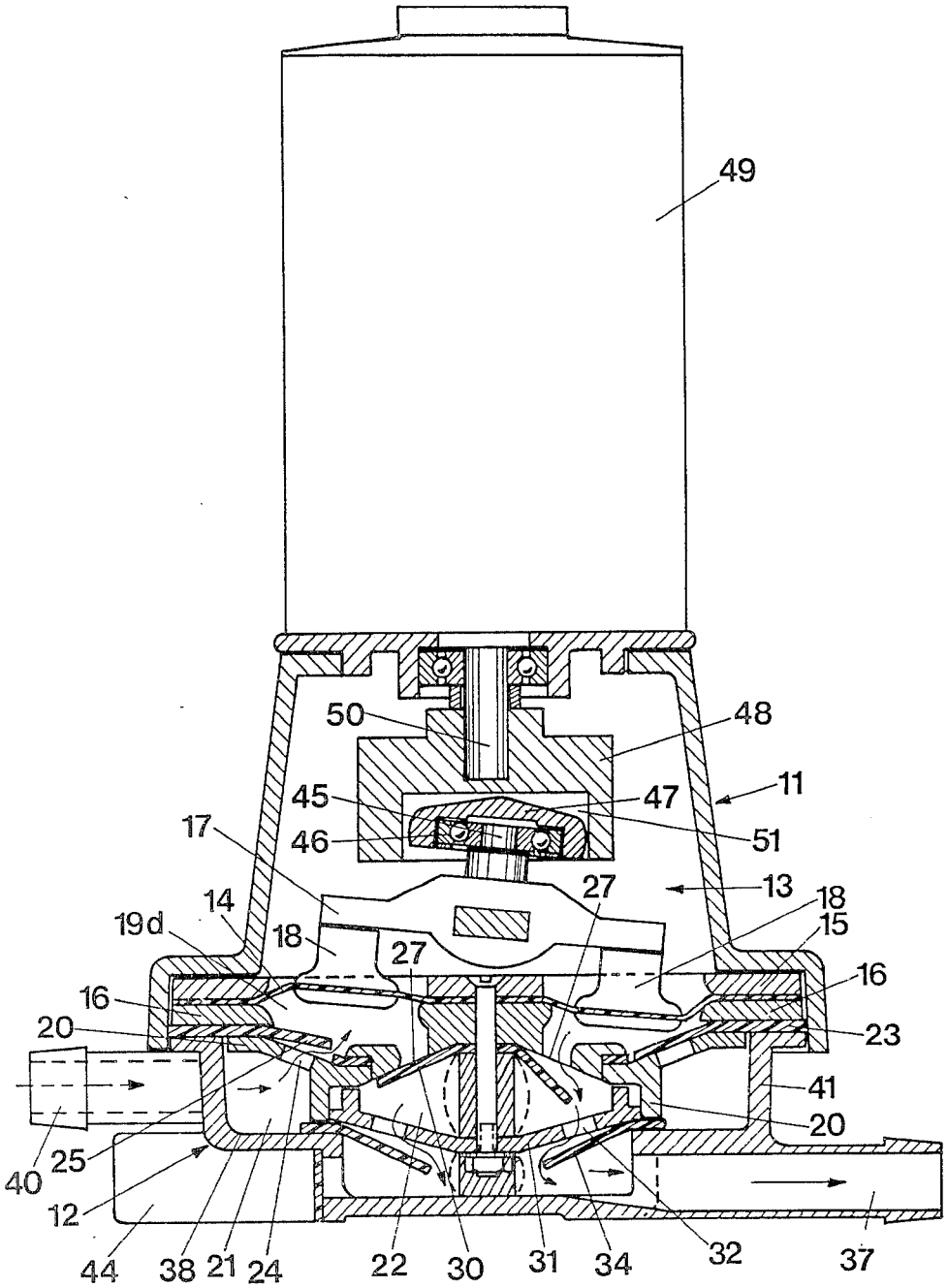
Figure 2:
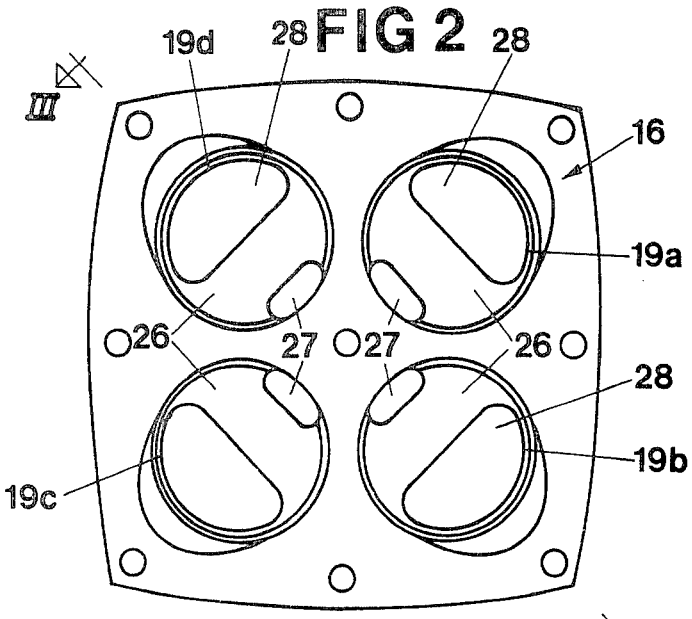
Figure 3:
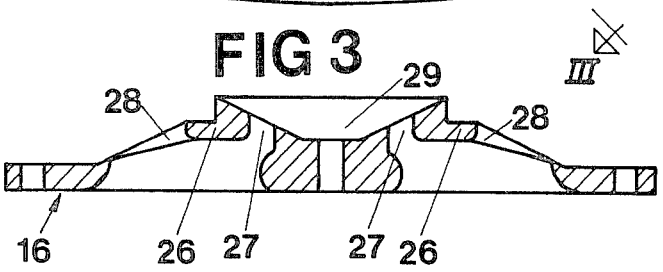
Figure 4:
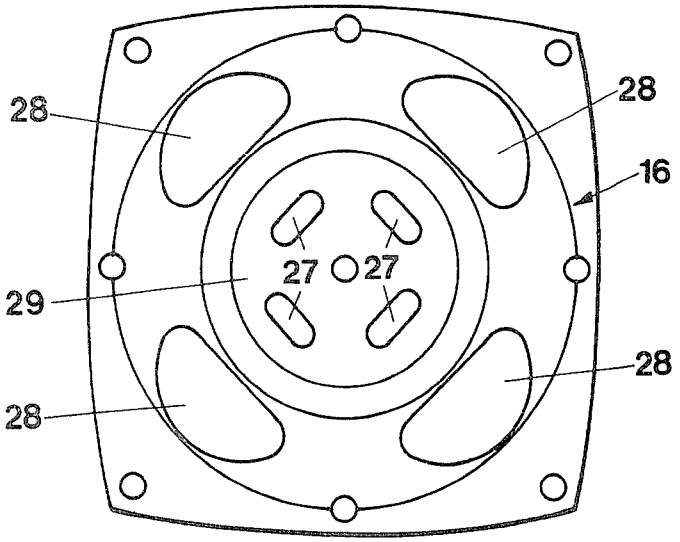
Figure 5:
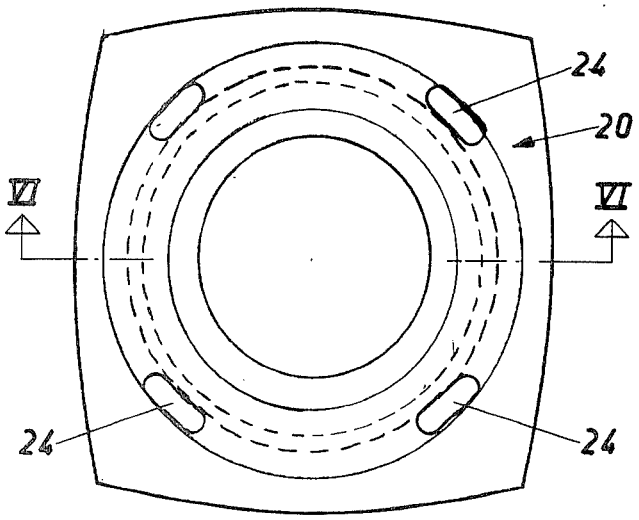
Figure 6:
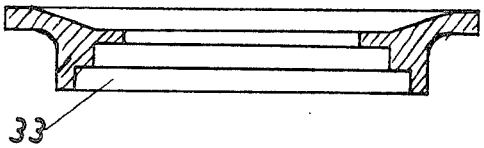
Figure 7:
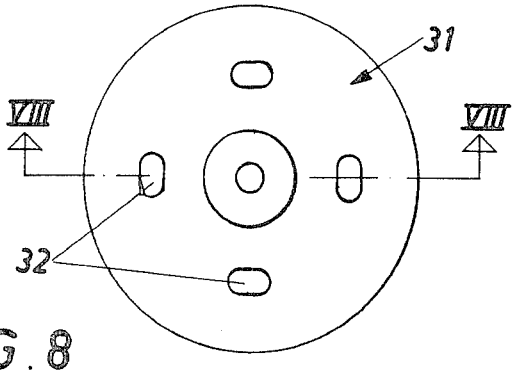
Figure 8:
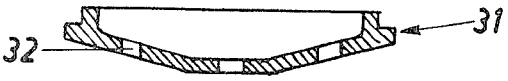
Figure 9:
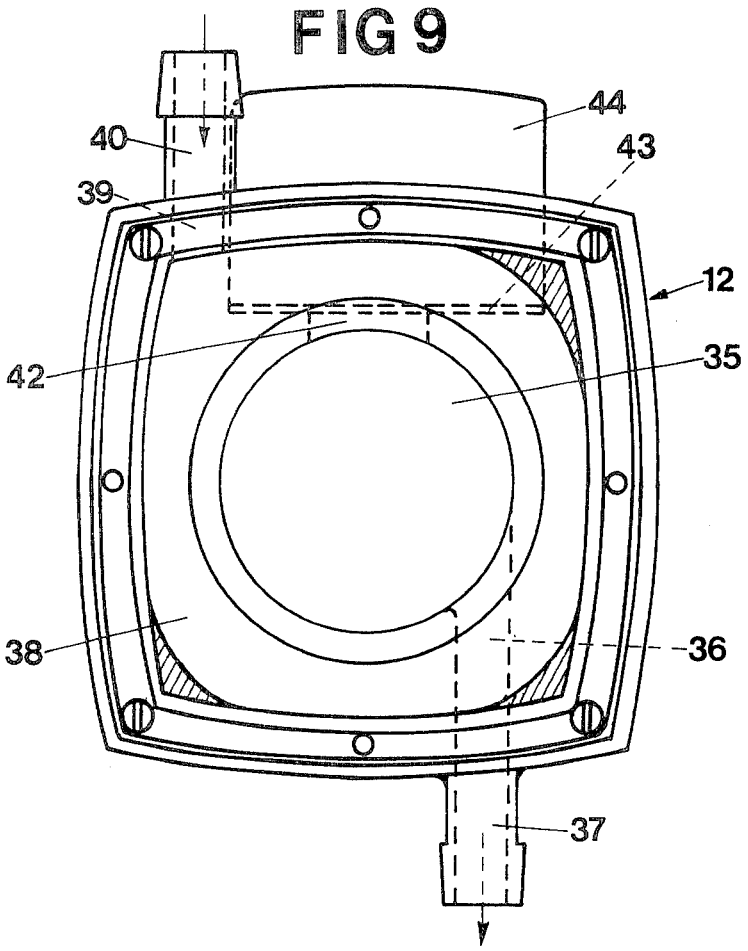
Figure 10:
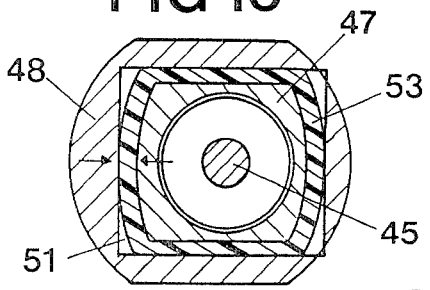
Figure 11:
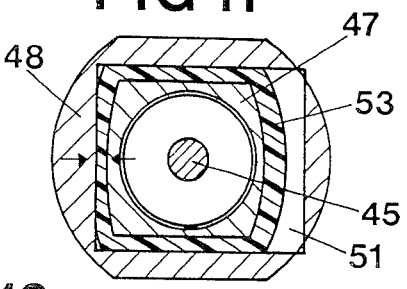
Figure 12:
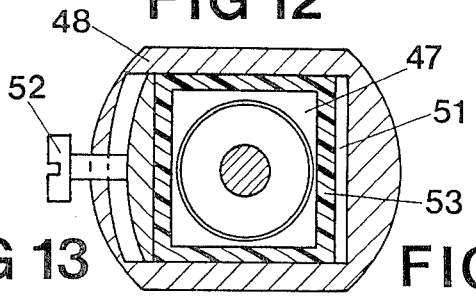
Figure 13:
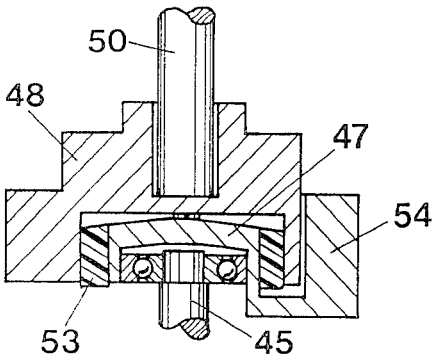
Figure 15:
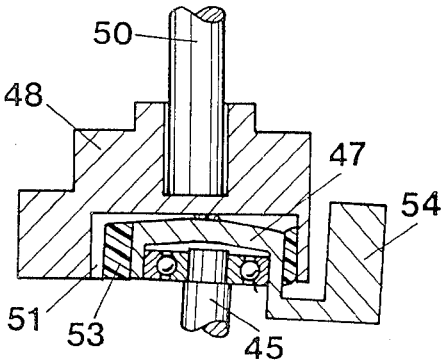
Figure 14:
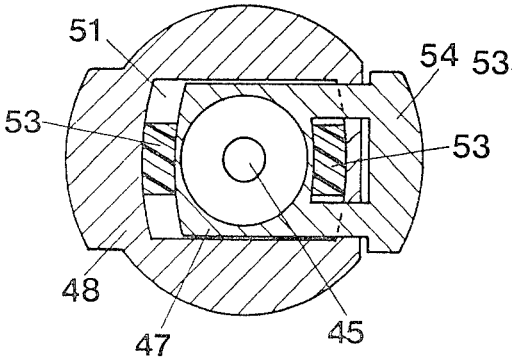
Figure 16:
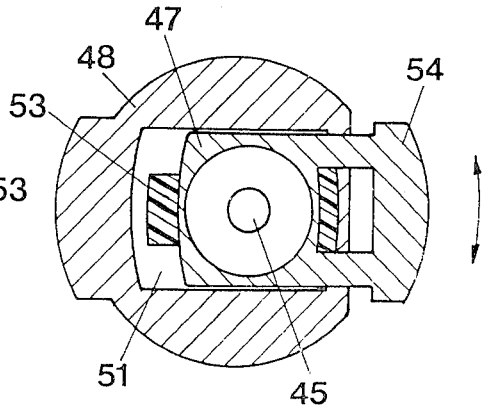

The features of the invention will now be described in detail below with reference to the accompanying drawings, wherein FIG. 1 is a vertical, sectional view taken diagonally through a diaphragm pump according to the invention, FIG. 2 is a view from above of the working chamber element of the pump, FIG. 3 is a sectional view on line III—III in FIG. 2, FIG. 4 is a view from below of the working chamber element, FIG. 5 is a view from above of the intermediate wall element of the pump, FIG. 6 is a sectional view on line VI—VI in FIG. 5, FIG. 7 is a view from below of the non-return valve plate of the intermediate wall element, FIG. 8 is a sectional view on line VIII—VIII in FIG. 7, FIG. 9 is a view from above of the bottom element of the pump housing, FIGS. 10 and 11 show the rotor and the carrier of the pump in two different relative positions, FIG. 12 shows a modified embodiment of the rotor according to FIGS. 10 and 11, and FIGS. 13–16 illustrate a further modified embodiment of the rotor and the carrier as a sectional view and an elevational view and in two different positions.

On the drawings numeral 11 indicates a pump housing, numeral 12 the bottom element of the pump housing, numeral 13 a movement transmission mechanism situated within the pump housing and numeral 14 indicates a diaphragm which is constricted between a diaphragm plate 15 and the working chamber element 16 of the pump. The movement transmission mechanism 13 is fixed at the diaphragm 14 which mechanism comprises a wobble plate 17, which via spacing means 18 is connected to the diaphragm 14. In the example of embodiment shown the pump comprises four working chambers 19*a–d*, but several or even less chambers can be provided. The minimum number is however restricted to two.

The working chambers 19 are at the top thereof defined by the diaphragm 14, at their sides and partly at the lower part thereof by the working chamber element 16 and at the lower part thereof by an intermediate wall element 20, which also forms a delimiting means beteen the inlet chamber 21 and the outlet chamber 22 of the pump. Between the working chamber element 16 and the intermediate wall element 20 a valve diaphragm 23 is constricted, in which flaps 25 are formed just in front of the inlet openings 24 in the intermediate wall element. In the central part of the element 16 outlet openings 27 are provided in the bottom 26 of the working chamber. The bottom 26 of the working chambers 19 occupies only about half the surface thereof and as to the rest this is occupied by a recess 28 situated just in front of the inlet openings 24 of the intermediate wall element 20.

The central middle portion of the element 16 is provided on its lower side with a cap-shaped cavity or recess 29, against which a rubber disk 30 is placed, which in cooperation with the outlet openings 27 acts as non-return valves.

In the example of embodiment shown the diaphragm pump is provided with a non-return valve plate 31 having outlet openings 32 and which plate can be tightly pressed into a central recess 33 in the intermediate wall element 20. On the lower side of the non-return valve 31 between the bottom element 12 of the pump housing and the intermediate wall element 20 is tightly clamped an angular rubber plate 34, which together with the outlet openings 32 forms four non-return valves. In accordance with this embodiment the pump can thus work as a pressure pump and if the non-return plate 31 together with the rubber ring 34 are removed a draining pump is obtained having a great lifting capacity but a small pressure on the outlet side.

In the bottom element 12 of the pump housing a circular recess 35 is provided, to which tangentially is connected an outlet port 36 to an outlet stud 37. On a level above the recess 35 an angular step 38 is formed in the bottom element 13 of the pump housing, to which step also tangentially is connected an inlet port 39, which transcends into an inlet stud 40. As previously mentioned the intermediate element 20 forms an inner delimiting means for the inlet chamber 21, the outer limit of which being formed by the step 38 and the side wall 41 of the bottom element 12. In one side wall of the bottom element 12 a cavity 42 which is outwardly opened is provided against which a diaphragm 43 is in contact and outside this a pressure switch 44.

As already mentioned the movement transmission mechanism 13 consists of a wobble plate 17, which via spacing means 18 is connected to the diaphragm for forming four working chambers 19. The wobble plate 17 is provided with a central guide shaft which via a roll bearing 46 is connected to a carrier 47. The carrier 47 which substantially is rectangular is axially displacable but unrotatably connected with a rotor 48 which is driven by the shaft 50 of the pump motor 49. In the rotor 48 an elongated groove or a cavity 51 is provided, which either per se can be eccentric in relation to the driving shaft 50 or can be provided with control means 52 for a variable adjustment of the eccentricity of the guide shaft 45 in relation to the driving shaft 50. In rotating the rotor 48 the guide shaft 45 will thus be imparted a movement along a circular path, i.e. the guide shaft performs a movement along the generatrics to a cone, the tip of the cone being directed towards the diaphragm 14. Due to this the wobble plate will perform a wobbling movement in such a way that the working chambers 19 temporarily and alternately function as pressure chambers and suction chambers.

To reduce breakdown risks in case of extreme counter pressures the carrier can be provided with resilient means 53 formed to hold the carrier in a preset eccentric position in relation to the driving shaft 50, as appears from FIG. 10. In case of an overloading the guide shaft 45 endeavours to reduce the eccentricity and will then perform a contact pressure against the resilient means, which for example can comprise a rubber coating surrounding the carrier. In FIG. 11 there is shown a position wherein the center of the guide shaft coincides with the center of the driving shaft, which means that no pumping effect is performed. As soon as the counter pressure has been overcome the carrier can return to its initial position.

If as the pump motor a 220 V single-phase motor shall be used this cannot in starting be directly loaded with full effect and in such a case it may be convenient to provide the carrier 47 with a centrifugal weight 54, which brings about, as appears from FIGS. 13–16, together with a centering means 53, for example two rubber blocks, that the electric motor can start with the guide shaft 45 situated axially in front of the driving shaft 50, that is without moving the wabble plate and thus without any appreciable load. In accelerating to normal speed the carrier will be gradually displaced due to the centrifugal force in such a way that the end of the guide shaft will be excentric in relation to the driving shaft 50. When the motor is stopped the carrier 47 will return to its original position by way of the centering means 53.

In order to obtain a more regular operation pressure equalizing means, for example pieces of foamed rubber having closed cells are provided in the inlet chambers 21 as well as in the outlet chambers 22. In case of pressure impacts these soft pressure equalizing means will thus absorb these impacts so that a regular and a substantially vibration free operation is obtained. Due to the fact that the diaphragm 14 only has to perform reciprocal movements this can be made of fabric, while the remaining diaphragms which all have sealing functions consist of rubber. The special design of the working chambers their large inlet- and outlet openings and the special construction of the valve diaphragms result in the fact that also relatively large impurities can pass through the pump without sealing problems. As already mentioned the pump can be changed in a very simple way from a pressure pump to a draining pump by removing the non-return valve plate 31 with its pertaining valve rubber plate 34. By way of the control means 52 the capacity of the pump can be changed in a very simple way. The whole pump can be manufactured in a convenient plastics material and is thus acid resistant and due to the diaphragm 14 also completely separated from the electric motor.

The invention is not restricted to the embodiments shown above but several modifications are possible within the scope of the following claims.

What is claimed is:

1. A diaphragm pump comprising:

a drive shaft having a rotor;

a least two working chambers provided with a diaphragm;

an inlet chamber and an outlet chamber, each communicating with said working chambers via a non-return valve for each chamber;

means for imparting to a reciprocal movement to the diaphragm, said means comprising a wobble plate which is fixed to and supported by said diaphragm, said wobble plate having a central guide shaft which is adjustable to different sloping positions with respect to said drive shaft, and wherein said guide shaft has a free end;

means for effecting rotation of said guide shaft in response to rotation of said drive shaft rotor, comprising: a carrier rotatably journalled on said guide shaft free end, said carrier being axially displaceable but unrotatably connected with said drive shaft rotor; and resilient means for holding said carrier in a preset eccentric position with respect to said drive shaft so that under overload conditions said carrier will press directly against said resilient means and reduce the eccentricity of said carrier with respect to said drive shaft; and wherein said resilient means comprises a pair of rubber blocks disposed in association with opposite ends of said carrier.

2. A pump as recited in claim 1 wherein said weight is connected to said carrier by a pair of arm portions, said arm poritons straddling one of said rubber blocks.

3. A diaphragm pump comprising:

a drive shaft having a rotor;

at least two working chambers provided with a diaphragm;

an inlet chamber and an outlet chamber, each communicating with said working chambers via a non-return valve for each chamber;

means for imparting to a reciprocal movement to the diaphragm, said means comprising a wobble plate which is fixed to and supported by said diaphragm, said wobble plate having a central guide shaft which is adjustable to different sloping positions with respect to said drive shaft, and wherein said guide shaft has a free end;

means for effecting rotation of said guide shaft in response to rotation of said drive shaft rotor, comprising: a carrier rotatably journalled on said guide shaft free end, said carrier being axially displaceable but unrotatably connected with said drive shaft rotor; and resilient means for holding said carrier in a preset eccentric position with respect to said drive shaft so that under overload conditions said carrier will press directly against said resilient means and reduce the eccentricity of said carrier with respect to said drive shaft; and a centrifugal weight disposed in operative association with said carrier, said weight positioned with respect to said carrier so that during normal acceleration of said guide shaft to a normal operating speed, said weight facilitates movements of said guide shaft to said preset eccentricity.

4. A pump as recited in claim 3 wherein said resilient means comprises a pair of rubber blocks disposed in association with opposite ends of said carrier.

5. A pump as recited in claim 4 further comprising a removable intermediate wall element provided with inlet openings and formed as a site for a non-returnable valve diaphragm, said intermediate wall element separating said inlet and outlet chambers of said pump.

6. A pump as recited in claim 5 further comprising a non-return valve plate removably positioned in a central part of said intermediate wall element, and within said outlet chamber.

7. A diaphragm pump comprising:

a drive shaft having a rotor;

at least two working chambers provided with a diaphragm;

an inlet chamber and an outlet chamber, each communicating with said working chambers via a non-return valve for each chamber;

means for imparting to a reciprocal movement to the diaphragm, said means comprising a wobble plate which is fixed to and supported by said diaphragm, said wobble plate having a central guide shaft which is adjustable to different sloping positions with respect to said drive shaft, and wherein said guide shaft has a free end;

means for effecting rotation of said guide shaft in response to rotation of said drive shaft rotor, comprising: a carrier rotatably journalled on said guide shaft free end, said carrier being axially displaceable but unrotatably connected with said drive shaft rotor; and resilient means for holding said carrier in a preset eccentric position with respect to said drive shaft so that under overload conditions said carrier will press directly against said resilient means and reduce the eccentricity of said carrier with respect to said drive shaft; and wherein said resilient means comprises a rubber coating disposed circumferentially around said carrier.

8. A pump as recited in claim 7 wherein said carrier has a substantially quadrate exterior configuration.

9. A pump as recited in claim 8 further comprising a removable intermediate wall element provided with inlet openings and formed as a site for a non-returnable valve diaphragm, said intermediate wall element separating said inlet and outlet chambers of said pump.

10. A pump as recited in claim 9 further comprising a non-return valve plate removably positioned in a central part of said intermediate wall element, and within said outlet chamber.

11. A pump as recited in claim 7 further comprising a removable intermediate wall element provided with inlet openings and formed as a site for a non-returnable valve diaphragm, said intermediate wall element separating said inlet and outlet chambers of said pump.

12. A pump as recited in claim 11 further comprising a non-return valve plate removably positioned in a central part of said intermediate wall element, and within said outlet chamber.

13. A diaphragm pump comprising:

a drive shaft having a rotor;

at least two working chambers provided with a diaphragm;

an inlet chamber and an outlet chamber, each communicating with said working chambers via a non-return valve for each chamber;

means for imparting to a reciprocal movement to the diaphragm, said means comprising a wobble plate which is fixed to and supported by said diaphragm, said wobble plate having a central guide shaft which is adjustable to different sloping positions with respect to said drive shaft, and wherein said guide shaft has a free end;

means for effecting rotation of said guide shaft in response to rotation of said drive shaft rotor, comprising: a carrier rotatably journalled on said guide shaft free end, said carrier being axially displaceable but unrotatably connected with said drive shaft rotor; and resilient means for holding said carrier in a preset eccentric position with respect to said drive shaft so that under overload conditions said carrier will press directly against said resilient means and reduce the eccentricity of said carrier with respect to said drive shaft;

said rotor including a groove extending substantially normal to said drive shaft, and said carrier being received in said groove and being displaceable in said groove from a position in which said guide shaft and said driving shaft are concentric, to another position in which said guide shaft and said drive shaft are eccentric; and wherein said resilient means comprises a rubber coating formed peripherally on, and surrounding, said carrier.

14. A pump as recited in claim 13 wherein said carrier has a substantially quadrate exterior configuration.

15. A pump as recited in claim 13 further comprising a removable intermediate wall element provided with inlet openings and formed as a site for a non-returnable valve diaphragm, said intermediate wall element separating said inlet and outlet chambers of said pump.

16. A pump as recited in claim 15 further comprising a non-return valve plate removably positioned in a central part of said intermediate wall element, and within said outlet chamber.

* * * * *